US009090052B2

(12) United States Patent
Shigeta

(10) Patent No.: US 9,090,052 B2
(45) Date of Patent: Jul. 28, 2015

(54) MEMBER WITH CONCAVE PORTION AND METHOD FOR MANUFACTURING SAME

(75) Inventor: Tatsuo Shigeta, Chiba (JP)

(73) Assignee: THINK LABORATORY CO., LTD., Chiba (JP)

( * ) Notice: Subject to any disclaimer, the term of this patent is extended or adjusted under 35 U.S.C. 154(b) by 97 days.

(21) Appl. No.: 13/976,658

(22) PCT Filed: Feb. 14, 2012

(86) PCT No.: PCT/JP2012/053315

§ 371 (c)(1),
(2), (4) Date: Jun. 27, 2013

(87) PCT Pub. No.: WO2012/111637

PCT Pub. Date: Aug. 23, 2012

(65) Prior Publication Data

US 2013/0269554 A1 Oct. 17, 2013

(30) Foreign Application Priority Data

Feb. 14, 2011 (JP) ..... 2011-028634

(51) Int. Cl.
*B41F 13/10* (2006.01)
*B41F 7/20* (2006.01)
(Continued)

(52) U.S. Cl.
CPC ... *B41F 7/20* (2013.01); *B41N 1/06* (2013.01); *B41N 1/12* (2013.01); *B41N 1/20* (2013.01); *B41N 3/003* (2013.01); *B41C 1/18* (2013.01); *B41N 1/02* (2013.01); *B41N 1/16* (2013.01); *B41N 1/18* (2013.01)

(58) Field of Classification Search
CPC ..... C23C 28/343; B05D 5/04
USPC ..... 101/377
See application file for complete search history.

(56) References Cited

U.S. PATENT DOCUMENTS 4,862,799 A * 9/1989 Hycner et al. ..... 101/348
4,986,181 A * 1/1991 Kobayashi et al. ..... 101/348
(Continued)

FOREIGN PATENT DOCUMENTS

JP 07-256854 10/1995
JP 2000-010300 A 1/2000
(Continued)

OTHER PUBLICATIONS

International Search Report for PCT/JP2012/053315 issued Mar. 13, 2012.
(Continued)

*Primary Examiner* — Anthony Nguyen
(74) *Attorney, Agent, or Firm* — Fishman Stewart Yamaguchi PLLC

(57) ABSTRACT

Provided are a member with recessed portions which solves the problem of fogging, and a method of manufacturing the same. The member with recessed portions, includes: a printing area in which a large number of recessed portions are formed on a surface thereof; and a non-printing area in which the recessed portions are not formed on the surface thereof, the surface being brought into contact with a viscous material so that the viscous material accumulates in the recessed portions, the excess viscous material being scraped off the surface by causing a doctor blade to horizontally stick up on the surface and relatively moving the doctor blade. The member with recessed portions further includes: a base member having the printing area in which the large number of recessed portions are formed on the surface and the non-printing area in which the recessed portions are not formed on the surface; and a DLC coating formed so as to cover the printing area and the non-printing area. The surface is provided with a plurality of grinding traces, which are formed by grinding the DLC coating, and form an inclined angle of other than 0° and 90° with respect to an imaginary extension of the doctor blade which horizontally sticks up on the surface.

28 Claims, 3 Drawing Sheets

(51) Int. Cl.

| | |
|---|---|
| ***B41N 1/06*** | (2006.01) |
| ***B41N 1/20*** | (2006.01) |
| ***B41N 1/12*** | (2006.01) |
| ***B41N 3/00*** | (2006.01) |
| *B41C 1/18* | (2006.01) |
| *B41N 1/02* | (2006.01) |
| *B41N 1/16* | (2006.01) |
| *B41N 1/18* | (2006.01) |

(56) References Cited

U.S. PATENT DOCUMENTS

| | | | | |
|---|---|---|---|---|
| 2007/0148462 | A1* | 6/2007 | Hsiao et al. | 428/408 |
| 2009/0301326 | A1* | 12/2009 | Barr et al. | 101/328 |
| 2011/0195265 | A1* | 8/2011 | Oohira et al. | 428/552 |
| 2011/0203468 | A1* | 8/2011 | Harada et al. | 101/375 |

FOREIGN PATENT DOCUMENTS

| | | | |
|---|---|---|---|
| JP | 3022986 | B2 | 3/2000 |
| JP | 2004-249696 | A | 9/2004 |
| JP | 2007-130996 | A | 5/2007 |
| JP | 2009-093170 | A | 4/2009 |
| WO | WO-2007-135898 | A1 | 11/2007 |

OTHER PUBLICATIONS

International Preliminary Report on Patentability & Written Opinion issued Aug. 21, 2013 for corresponding PCT Application No. PCT/JP20125/053315.

* cited by examiner

MEMBER WITH CONCAVE PORTION AND METHOD FOR MANUFACTURING SAME

TECHNICAL FIELD

The present invention relates to a member with recessed portions, which has a large number of minute recessed portions provided on a surface thereof by diamond like carbon (DLC), and a method of manufacturing the same.

BACKGROUND ART

A gravure printing cylinder and a deep-etch offset plate are members with recessed portions, which have on the surface thereof a printing area in which a large number of minute recessed portions are formed and a non-printing area in which the recessed portions are not formed. With regard to a gravure printing cylinder, for example, as described in Patent Document 1, a technology which uses diamond like carbon (DLC) as a hard coating for covering gravure cells is known.

On the other hand, as a member with recessed portions, which has on the surface thereof a printing area in which a large number of minute recessed portions are formed and a non-printing area in which the recessed portions are not formed, an application cylinder which can uniformly apply to a target an adhesive, in particular, an adhesive for dry lamination to be used for a material for packaging food, drink, a pharmaceutical drug, or the like is known.

Further, as a member with recessed portions, which has on the surface thereof a printing area in which a large number of minute recessed portions are formed and a non-printing area in which the recessed portions are not formed, a gravure printing cylinder or the like is used in printing conductive paste such as functional ink including ink containing silver paste when an electronic component such as a circuit board, a ceramic electronic component, a front filter of a plasma display panel (PDP), or an electro-magnetic shielding and light transmitting window material is manufactured.

These members with recessed portions such as a gravure printing roll, a deep-etch offset plate, and an application cylinder are used under a state in which a cutting edge of a doctor blade is horizontally held in contact with the surface thereof to scrape a viscous material such as excess ink or adhesive on the surface thereof.

However, when DLC is used as a hard coating for covering the surface, the friction coefficient of DLC is low, and thus, there is a problem in that ink in the non-printing area cannot be scraped well by the doctor blade, and so-called fogging is caused.

PRIOR ART DOCUMENTS

Patent Documents

Patent Document 1: JP 2007-130996 A
Patent Document 2: JP 2009-093170 A

SUMMARY OF THE INVENTION

Problems to be Solved by the Invention

The present invention has been made in view of the above-mentioned problem of the conventional art, and an object of the present invention is to provide a member with recessed portions which solves the problem of fogging, and a method of manufacturing the same.

Means for Solving Problem

In order to solve the above-mentioned problem, according to the present invention, there is provided a member with recessed portions, including: a printing area in which a large number of recessed portions are formed on a surface thereof, and a non-printing area in which the recessed portions are not formed on the surface thereof, the surface being brought into contact with a viscous material so that the viscous material accumulates in the recessed portions, the excess viscous material being scraped off the surface by causing a doctor blade to horizontally stick up on the surface and relatively moving the doctor blade, in which: the member with recessed portions further includes: a base member having the printing area in which the large number of recessed portions are formed on the surface and the non-printing area in which the recessed portions are not formed on the surface; and a DLC coating formed so as to cover the printing area and the non-printing area; and the surface is provided with a plurality of grinding traces, which are formed by grinding the DLC coating, and form an inclined angle of other than 0° and 90° with respect to an imaginary extension of the doctor blade which horizontally sticks up on the surface.

DLC has low frictional resistance and high sliding performance, and thus, ink on the surface of the member with recessed portions without a pattern (without a cell), that is, ink in the non-printing area, cannot be scraped well, and the problem of fogging arises. By grinding the surface to be coarse to increase the frictional resistance, the problem of fogging can be solved.

Further, it is suitable that the plurality of grinding traces have a first angle corresponding to the inclined angle of other than 0° and 90° with respect to the imaginary extension of the doctor blade and a second angle corresponding to the inclined angle of other than 0° and 90° with respect to the imaginary extension of the doctor blade, and grinding traces at the first angle and grinding traces at the second angle intersect each other.

It is preferred that a depth of the plurality of grinding traces be equal to or larger than 0.05 μm and smaller than 0.3 μm. Further, it is preferred that the grinding is sandpaper grinding, and it is preferred to carry out grinding with a grit size of, for example, #1000 to 3000.

It is suitable that an arithmetic mean roughness Sa of the surface in the non-printing area of the member with recessed portions be 0.005 to 0.10 μm. In this case, the arithmetic mean roughness Sa is a three-dimensional extension of a two-dimensional arithmetic mean roughness Ra, and is the volume surrounded by the curved surface shape and a mean plane divided by the measured area. When the mean plane is an xy plane, the vertical direction is a z axis, and the measured curved surface shape is z=f(x,y), the arithmetic mean roughness Sa is defined as follows.

$$Sa = \frac{1}{L_x L_y} \int_0^{Lx} \int_0^{Ly} f(x, y)\,dx\,dy \qquad \text{[Numerical Equation 1]}$$

In the Numerical Equation 1, Lx is the measured length in an x direction and Ly is the measured length in a y direction. These are determined by noncontact surface profile measurement using laser light or an electron beam.

The inclined angle of the traces of the grinding with respect to the imaginary extension of the doctor blade which horizontally sticks up on the surface is preferably 10° to 80°, and more preferably 30° to 60°.

It is suitable that the depth of the recessed portions be 1 μm to 50 μm, but the depth is more preferably 5 to 15 μm, and further preferably 5 to 10 μm. The reason is that the amount of ink, adhesive, a functional material, or the like supplied to the recessed portions may be small.

As a first aspect of the base member, it is preferred that the base member include a cylindrical or flat plate-like base material, and a metal layer provided on a surface of the cylindrical or flat plate-like base material and having the large number of recessed portions formed on the surface thereof. According to the first aspect of the base member, it is suitable that the recessed portions be formed by corrosion treatment, and, as the base material, aluminum, iron, or a composite material such as a carbon fiber reinforced resin is preferred. Further, according to the first aspect of the base member, as the metal layer, copper and/or nickel are preferred. In particular, it is suitable to form the base member by applying copper plating onto the surface of the base material, applying a photosensitive material onto the copper plating, carrying out exposure and development, and after that, corroding the copper plating to form the recessed portions, and applying on the surface thereof an underlying metal plating layer such as nickel plating or chromium plating.

As a second aspect of the base member, it is preferred that the base member include a cylindrical or flat plate-like base material, a metal layer provided on a surface of the cylindrical or flat plate-like base material, and a patterning layer formed by exposing and developing a photosensitive material provided on the metal layer. According to the second aspect of the base member, the recessed portions are not formed by corrosion treatment, but are achieved by patterning of the photosensitive material provided on the metal layer. As the base material, aluminum, iron, or a composite material such as a carbon fiber reinforced resin is preferred. Further, according to the second aspect of the base member, as the metal layer, copper and/or nickel are preferred. In particular, by applying copper plating onto the surface of the base material, applying nickel plating onto the copper plating, applying the photosensitive material onto the nickel plating, and carrying out exposure and development, the recessed portions are formed on the nickel plating.

It is further preferred that the base material include a cushion layer formed of a rubber or a resin having a cushioning property. In other words, the base material may be formed on the cushion layer formed of a rubber or a resin having a cushioning property. As the cushion layer, a synthetic rubber such as silicone rubber or an elastic synthetic resin such as polyurethane or polystyrene can be used. As long as the cushion layer is thick enough to have the cushioning property, that is, resilience, the thickness of the cushion layer is not specifically limited. For example, a thickness of about 1 cm to 5 cm is sufficient. Examples of the base material including the cushion layer formed of a rubber or a resin having a cushioning property include the gravure plate described in Patent Document 2.

It is preferred that a thickness of the DLC coating be 0.1 μm to several tens of micrometers. More specifically, the thickness is preferably 0.1 μm to 20 μm, and more preferably 0.1 μm to 5 μm. In forming the DLC coating, it is preferred to form the thin film by CVD or sputtering.

It is preferred that the member with recessed portion be a gravure printing cylinder. The reason is that the problem of fogging is solved and the printability is improved to ease printing. The gravure printing cylinder as the member with recessed portions according to the present invention is suitably used for package printing, and in addition, is also suitably used for, for example, printing functional ink including ink containing silver paste in manufacturing an electronic component.

It is preferred that the member with recessed portion be a deep-etch offset plate. The reason is that the problem of fogging is solved and the printability is improved to ease printing.

It is suitable that the member with recessed portion be an application cylinder. The application cylinder is suitably used as, for example, an application cylinder for uniformly applying to a target an adhesive, in particular, an adhesive for dry lamination used for a material for packaging food, drink, a pharmaceutical drug, or the like.

According to the present invention, there is provided a product manufactured by using the member with recessed portions.

According to the present invention, there is provided a method of manufacturing member with recessed portions, the member with recessed portions including: a printing area in which a large number of recessed portions are formed on a surface thereof, and a non-printing area in which the recessed portions are not formed on the surface thereof, the surface being brought into contact with a viscous material so that the viscous material accumulates in the recessed portions, the excess viscous material being scraped off the surface by causing a doctor blade to horizontally stick up on the surface and relatively moving the doctor blade, in which: the method including the steps of manufacturing a base member having the printing area in which the large number of recessed portions are formed on the surface and the non-printing area in which the recessed portions are not formed on the surface; forming a DLC coating so as to cover the printing area and the non-printing area; and forming a plurality of grinding traces by grinding the DLC coating, the plurality of grinding traces forming an inclined angle of other than 0° and 90° with respect to an imaginary extension of the doctor blade which horizontally sticks up on the surface.

Further, it is suitable that the step of forming the plurality of grinding traces includes forming the plurality of grinding traces having a first angle corresponding to the inclined angle of other than 0° and 90° with respect to the imaginary extension of the doctor blade and a second angle corresponding to the inclined angle of other than 0° and 90° with respect to the imaginary extension of the doctor blade so that grinding traces at the first angle and grinding traces at the second angle intersect each other.

It is preferred that a depth of the plurality of grinding traces be 0.05 μm to 0.3 μm. Further, it is preferred that the grinding be sandpaper grinding, and it is preferred to carry out grinding with a grit size of, for example, #1000 to 3000.

It is preferred that an arithmetic mean roughness Sa of the surface in the non-printing area of the member with recessed portions be 0.005 to 0.10 μm.

It is suitable that a depth of the recessed portions be 1 μm to 50 μm, but the depth is more preferably 5 to 15 μm, and further preferably 5 to 10 μm. The reason is that the amount of ink, adhesive, a functional material, or the like supplied to the recessed portions may be small.

It is suitable that a first aspect of the manufacturing a base member include the steps of preparing a cylindrical or flat plate-like base material; providing a metal layer on a surface of the cylindrical or flat plate-like base material; and forming by corrosion the large number of recessed portions on a surface of the metal layer. According to the first aspect of the manufacturing a base member, it is suitable that the recessed portions be formed by corrosion treatment, and as the base material, aluminum, iron, or a composite material such as a carbon fiber reinforced resin is preferred. Further, according to the first aspect of the manufacturing a base member, as the metal layer, copper and/or nickel is preferred. In particular, it is suitable to form the base member by applying copper plating onto the surface of the base material, applying a photosensitive material onto the copper plating, carrying out exposure and development, and after that, corroding the copper plating to form the recessed portions, and applying onto the surface thereof an underlying metal plating layer such as nickel plating or chromium plating.

It is preferred that a second aspect of the manufacturing a base member include the steps of; preparing a cylindrical or flat plate-like base material; providing a metal layer on a surface of the cylindrical or flat plate-like base material; and forming a patterning layer by exposing and developing a photosensitive material provided on the metal layer. According to the second aspect of the manufacturing a base member, the recessed portions are not formed by corrosion treatment, but are achieved by patterning of the photosensitive material provided on the metal layer. As the base material, aluminum, iron, or a composite material such as a carbon fiber reinforced resin is preferred. Further, according to the second aspect of the manufacturing a base member, as the metal layer, copper and/or nickel is preferred. In particular, by applying copper plating onto the surface of the base material, applying nickel plating onto the copper plating, applying the photosensitive material onto the nickel plating, and carrying out exposure and development, the recessed portions are formed on the nickel plating.

It is further preferred that the base material include a cushion layer formed of a rubber or a resin having a cushioning property. In other words, the base material may be formed on the cushion layer formed of a rubber or a resin having a cushioning property. As the cushion layer, a synthetic rubber such as silicone rubber or an elastic synthetic resin such as polyurethane or polystyrene can be used. As long as the cushion layer is thick enough to have the cushioning property, that is, resilience, the thickness of the cushion layer is not specifically limited. For example, a thickness of about 1 cm to 5 cm is sufficient. Examples of the base material including the cushion layer formed of a rubber or a resin having a cushioning property include the gravure plate described in Patent Document 2.

It is preferred that the thickness of the DLC coating be 0.1 μm to several tens of micrometers. More specifically, the thickness is preferably 0.1 μm to 20 μm and more preferably 0.1 μm to 5 μm. In forming the DLC coating, it is preferred to form the thin film by CVD or sputtering.

Effect of the Invention

The present invention may produce a remarkable effect of providing the member with recessed portions which solves the problem of fogging, and the method of manufacturing the same.

MODES FOR CARRYING OUT THE INVENTION

Embodiments of the present invention are described below, but the embodiments are merely exemplary embodiments. It goes without saying that various modifications can be made thereto without departing from the technical concept of the present invention.

In the figures, reference symbol 10A denotes a member with recessed portions according to the present invention. The figures represent an example in which the member 10A with recessed portions is a gravure printing cylinder for gravure printing (FIG. 1).

Figure 1:
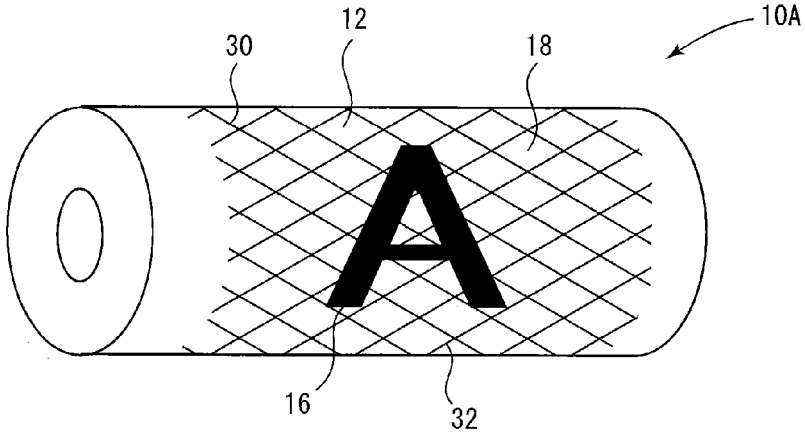
FIG. 1 is a schematic diagram of an exemplary member with recessed portions according to the present invention.

Description is made with reference FIG. 1 to FIG. 5. The member 10A with recessed portions has on a surface 12 a printing area 16 in which a large number of recessed portions 14 (gravure cells in the case of a gravure printing cylinder) are formed and a non-printing area 18 in which the recessed portions 14 are not formed, that is, a smooth surface area without the recessed portions 14 (FIG. 1). By bringing the surface 12 into contact with a viscous material 20 (ink in the illustrated example), the viscous material 20 accumulates in the recessed portions 14. By causing a doctor blade 22 to horizontally stick up on the surface 12 and relatively moving the doctor blade 22 (in the example illustrated in FIG. 4, the member 10A with recessed portions which is a gravure printing cylinder rotates), the excess viscous material 20 is scraped off the surface 12 of the member with recessed portions. The member 10A with recessed portions includes a base member 24A having on the surface 12 the printing area 16 in which the large number of recessed portions 14 are formed and the non-printing area 18 in which the recessed portions 14 are not formed, and a DLC coating 26 is formed so as to cover the printing area 16 and the non-printing area 18. By grinding the DLC coating 26, a plurality of grinding traces 30 and 32 are formed, which form inclined angles of other than 0° and 90° with respect to an imaginary extension 28 of the doctor blade 22 which horizontally sticks up on the surface 12.

Figure 4:
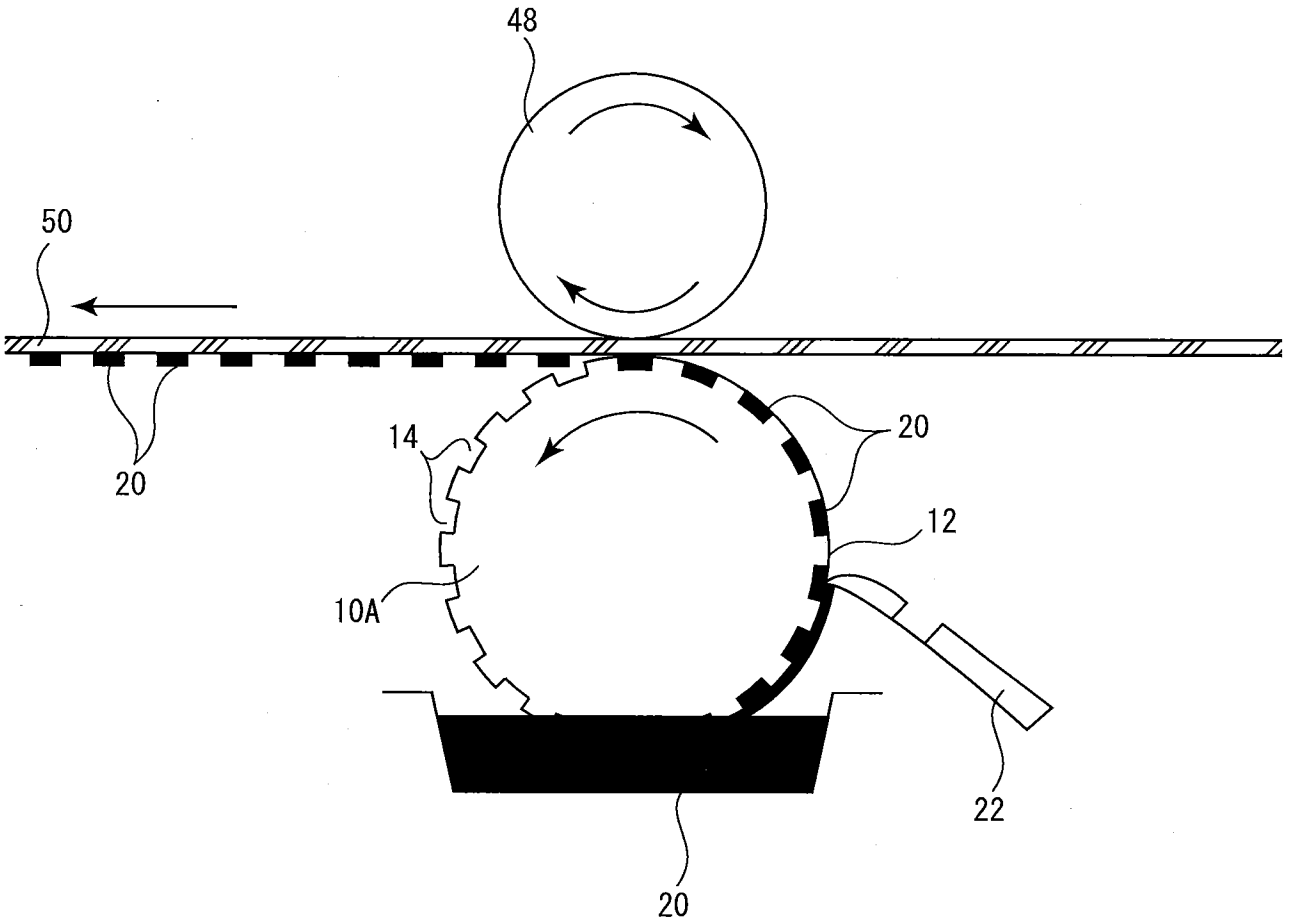
FIG. 4 is an explanatory diagram illustrating exemplary gravure printing.

Note that, in FIG. 4, reference symbols 48 and 50 denote an impression cylinder and a target of the printing such as paper or a plastic film, respectively.

Figure 2:
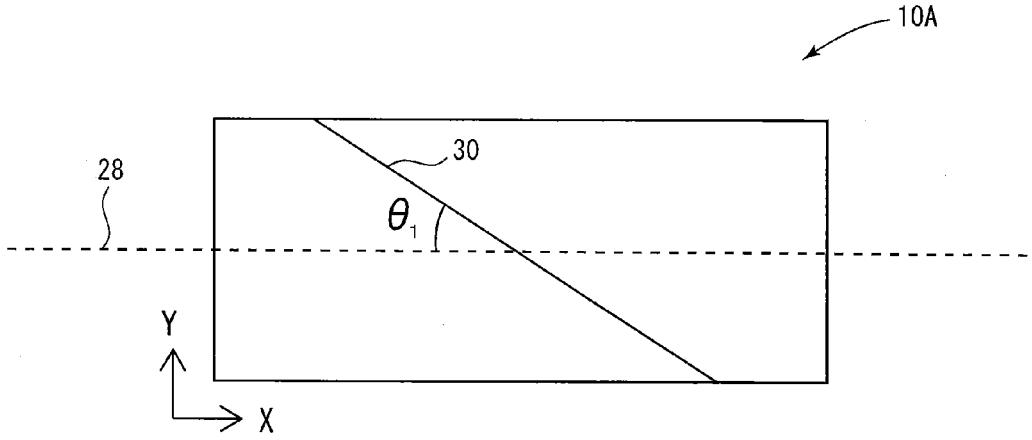
FIG. 2 is an explanatory diagram illustrating an exemplary grinding trace in the member with recessed portions.
Figure 3:
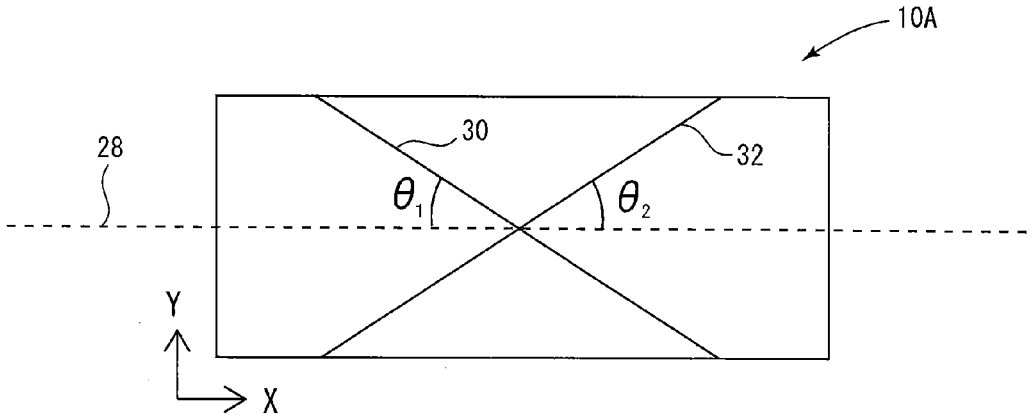
FIG. 3 is an explanatory diagram illustrating other exemplary grinding traces in the member with recessed portions.

The imaginary extension 28 of the doctor blade 22 which horizontally sticks up on the surface 12 is a line in parallel with a direction of an X axis (width direction) when the X axis and a Y axis are taken as illustrated in FIG. 2 and FIG. 3 with respect to the plate surface of the member 10A with recessed portions. Therefore, the plurality of grinding traces 30 and 32 are formed, which form inclined angles of other than 0° and 90° with respect to a reference line in parallel with the direction of the X axis on the plate surface.

As illustrated in FIG. 2, the grinding traces 30 and 32 may form only one first angle $\theta_1$ corresponding to the inclined angle of other than 0° and 90° (30° in the examples illustrated in FIG. 2 and FIG. 3) with respect to the imaginary extension 28 of the doctor blade 22, but it is suitable that the grinding traces 30 and 32 also have a second angle $\theta_2$ corresponding to the inclined angle of other than 0° and 90° (30° in the examples illustrated in FIG. 2 and FIG. 3) with respect to the imaginary extension 28 of the doctor blade 22 and that the grinding trace 30 at the first angle θ1 and the grinding trace 32 at the second angle θ2 intersect each other. FIG. 1 illustrates an example in which such intersection is made.

In manufacturing the member 10A with recessed portions, by manufacturing the base member 24A, which has on the surface 12 the printing area 16 in which the large number of recessed portions 14 are formed and the non-printing area 18 in which the recessed portions 14 are not formed, forming the DLC coating 26 so as to cover the printing area 16 and the non-printing area 18, and grinding the DLC coating 26, the plurality of grinding traces 30 and 32 may be formed, which form inclined angles of other than 0° and 90° with respect to the imaginary extension 28 of the doctor blade 22 which horizontally sticks up on the surface.

Figure 5:
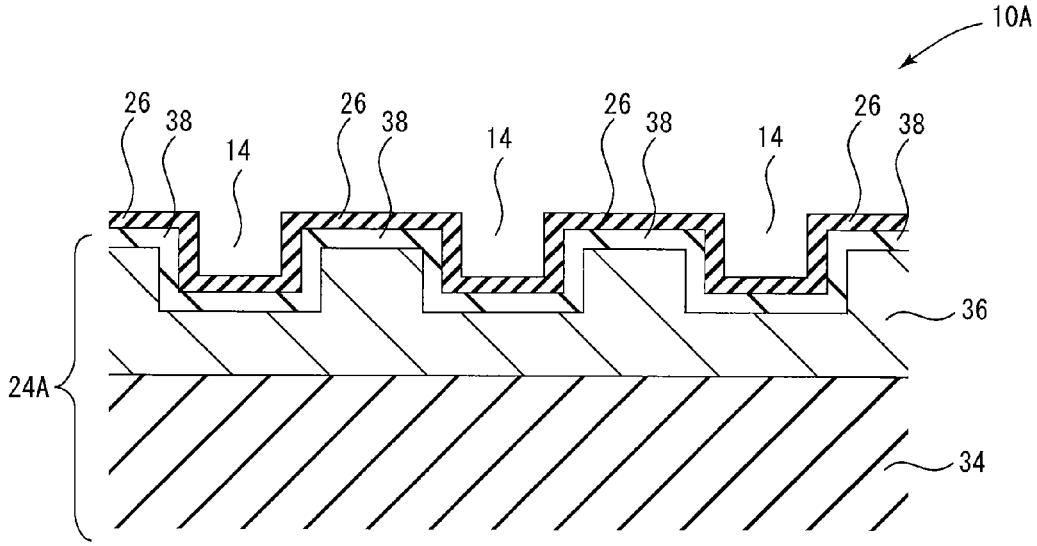
FIG. 5 is a sectional view of a member with recessed portions according to one embodiment of the present invention.
Figure 6:
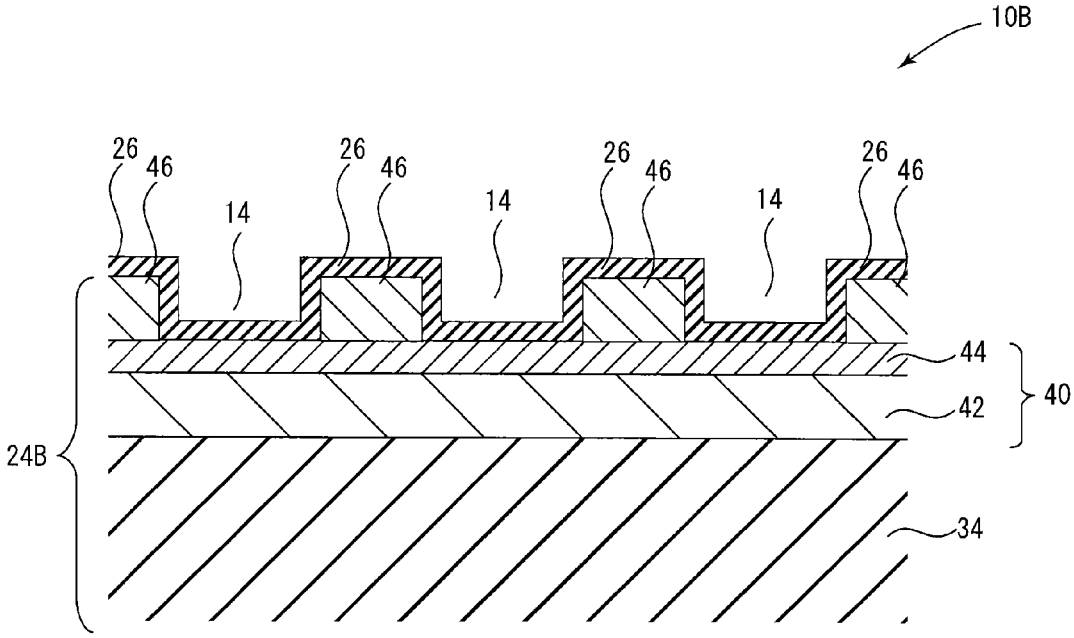
FIG. 6 is a sectional view of a member with recessed portions according to another embodiment of the present invention.

Further, the base member on which the DLC coating is provided may have, for example, a structure illustrated in FIG. 5 or FIG. 6.

In FIG. 5, the base member 24A is a base member including a cylindrical or flat plate-like base material 34 and a metal layer 36 (copper plating in the illustrated example) provided on the surface of the cylindrical or flat plate-like base material 34 (cylindrical aluminum roll in the illustrated example) and having the large number of recessed portions formed on the surface thereof. The metal layer 36 further has a nickel plating layer 38 provided thereon. The DLC coating 26 is formed on the nickel plating layer 38 to form the member 10A with recessed portions. Note that, in the illustrated example, a case in which the nickel plating layer 38 is formed as an underlying metal layer is exemplified, but chromium plating may also be used as the underlying metal layer.

The base member 24A is manufactured by preparing the cylindrical or flat plate-like base material 34 (cylindrical aluminum roll in the illustrated example), providing the metal layer 36 (copper plating in the illustrated example) on the surface of the cylindrical or flat plate-like base material 34, applying a photosensitive material on the surface of the metal layer 36, carrying out exposure and development, and after that, forming by corrosion the large number of recessed portions on the surface of the metal layer 36, and applying nickel plating to form the nickel plating layer 38. Note that, in the illustrated example, a case in which the nickel plating layer 38 is formed as an underlying metal layer is exemplified, but chromium plating may also be used as the underlying metal layer.

Further, a base member 24B illustrated in FIG. 6 is a base member including the cylindrical or flat plate-like base material 34, a metal layer 40 (copper plating layer 42 and nickel plating layer 44 in the illustrated example) provided on the surface of the cylindrical or flat plate-like base material 34 (cylindrical aluminum roll in the illustrated example), and a patterning layer 46 formed by exposing and developing a photosensitive material provided on the metal layer 40. The DLC coating 26 is formed on the patterning layer 46 and the nickel plating layer 44 to form a member 10B with recessed portions.

In the base member 24B, the recessed portions 14 are not formed by corrosion treatment, but are achieved by patterning of the photosensitive material provided on the metal layer 40.

The base member 24B is manufactured by preparing the cylindrical or flat plate-like base material 34 (cylindrical aluminum roll in the illustrated example), providing the metal layer 40 (copper plating layer 42 and nickel plating layer 44 in the illustrated example) on the surface of the cylindrical or flat plate-like base material 34, applying the photosensitive material onto the metal layer 40, and carrying out exposure and development to form the patterning layer 46.

Note that, in the base member 24A and base member 24B, the cylindrical or flat plate-like base material 34 may include a cushion layer formed of a rubber or a resin having a cushioning property. In other words, the base material may be formed on the cushion layer formed of a rubber or a resin having a cushioning property. As the cushion layer, a synthetic rubber such as silicone rubber or an elastic synthetic resin such as polyurethane or polystyrene can be used. As long as the cushion layer is a thick enough to have the cushioning property, that is, resilience, the thickness of the cushion layer is not specifically limited. For example, a thickness of about 1 cm to 5 cm is sufficient. Examples of the base material including the cushion layer formed of a rubber or a resin having a cushioning property include the gravure plate described in Patent Document 2.

Further, description is made above about cases in which the member 10A with recessed portions and the member 10B with recessed portions are gravure printing cylinders, but, in the case of a deep-etch offset plate, a flat plate-like base material may be used. Further, the viscous material may be a functional material such as a functional ink. Further, in the case of an application cylinder, the viscous material is an adhesive or the like. In other words, any plate which uses a doctor blade falls within the member with recessed portions according to the present invention.

EXAMPLES

The present invention is described below more specifically by way of examples. It goes without saying that the examples are merely exemplary examples and may not be construed as restrictive.

Example 1

A plate base material (aluminum hollow roll) having a circumference of 600 mm and a length of 1,100 mm was prepared. Boomerang Line (an automatic laser gravure plate making roll manufacturing equipment manufactured by THINK LABORATORY Co., Ltd.) was used to carry out the steps up to formation of a copper plating layer and a nickel plating layer described below. First, the plate base material (aluminum hollow roll) was placed in a copper plating bath, and the entire hollow roll was immersed in a plating solution to form a copper plating layer of 80 μm at 20 A/dm$^2$ and 6.0 V. No rashes and pits were formed on the plated surface, and a uniform copper plating layer was obtained. The surface of the copper plating layer was polished by a four-head polisher (a polisher manufactured by THINK LABORATORY Co., Ltd.) to cause the surface of the copper plating layer to be a uniform polished surface. Next, the above-mentioned formed copper plating layer was used as the base material, and a photosensitive film (thermal resist: TSER2104 E4 (manufactured by THINK LABORATORY Co., Ltd.)) was applied onto the surface thereof (by a fountain coater), and drying was carried out. The thickness of the obtained photosensitive film measured by a film thickness gauge (F20 manufactured by Fillmetrics, Inc. and marketed by Matsushita Techno Trading Co., Ltd.) was 4 μm. Then, laser exposure was carried out and the image was developed. With regard to the above-mentioned laser exposure, Laser Stream FX was used and predetermined pattern exposure was carried out with the exposure condition of 500 mJ/cm$^2$. Further, with regard to the above-mentioned development, a TLD developer (a developer manufactured by THINK LABORATORY Co., Ltd.) was used with the developer dilution ratio of (undiluted solution: water=1:7) and the development was carried out at 24° C. for 90 seconds to form a predetermined resist pattern. Next, the above-mentioned formed resist pattern was used as an etching mask to corrode the copper surface. Cupric chloride liquid was used as corrosive liquid, and the corrosion was carried out by spraying at 35° C. for 100 seconds. Further, the depth of the corrosion was 15 μm. Then, sodium hydroxide was used with the dilution ratio of 20 g/L at 40° C. for 180 seconds to remove the resist. Then, the plate base material was placed in a nickel plating bath, and was halfway immersed in a plating solution to form a nickel plating layer of 2 μm at 2 A/dm$^2$ and 7.0 V. No rashes and pits were formed on the plated surface, and a uniform nickel plating layer was obtained.

A DLC coating film was formed by CVD on the surfaces of the nickel plating layer and the resist pattern. An intermediate layer was formed to have a thickness of 0.1 μm in an atmosphere of argon/hydrogen gas using hexamethyldisiloxane as a material gas at a film formation temperature of 80 to 120° C. for a film formation time period of 60 minutes. Then, a DLC layer was formed to have a thickness of 2 μm using toluene as a material gas at a film formation temperature of 80 to 120° C. for a film formation time period of 90 minutes.

The surface of the cylinder member obtained in this way was reciprocatively ground by a sandpaper grinding machine using a sandpaper having a grit size of #2000 (manufactured by 3M Company) at an angle of 30° for 2 minutes to form the grinding traces having a first angle which is 30° clockwise with respect to the imaginary extension of the doctor blade as illustrated in FIG. 3. Similarly, grinding traces having a second angle which is 30° counterclockwise with respect to the imaginary extension of the doctor blade were formed so that the grinding traces at the first angle and the grinding traces at the second angle intersect each other. When the grinding traces were observed under a light interference microscope, each of the grinding traces had the depth of 0.2 μm and the arithmetic mean roughness Sa of the surface in the non-printing area of 0.03.

The member with recessed portions obtained in this way was used to carry out package printing by gravure printing. A beautiful package was obtained without causing fogging.

Example 2

A plate base material (aluminum hollow roll) having a circumference of 600 mm and a length of 1,100 mm was prepared. Boomerang Line (an automatic laser gravure plate making roll manufacturing equipment manufactured by THINK LABORATORY Co., Ltd.) was used to carry out the steps up to formation of a copper plating layer and a nickel plating layer described below. First, the plate base material (aluminum hollow roll) was placed in a copper plating bath, and the entire hollow roll was immersed in a plating solution to form a copper plating layer of 80 μm at 20 A/dm$^2$ and 6.0 V. No rashes and pits were formed on the plated surface, and a uniform copper plating layer was obtained. The surface of the copper plating layer was polished by a four-head polisher (a polisher manufactured by THINK LABORATORY Co., Ltd.) to cause the surface of the copper plating layer to be a uniform polished surface. Then, the plate base material was placed in a nickel plating bath, and was halfway immersed in a plating solution to form a nickel plating layer of 2 μm at 2 A/dm$^2$ and 7.0 V. No rashes and pits were formed on the plated surface, and a uniform nickel plating layer was obtained. With use of the above-mentioned formed nickel plating layer as the base material, a photosensitive film (thermal resist: TSER-NS (manufactured by THINK LABORATORY Co., Ltd.)) was applied on the surface thereof (by a fountain coater), and drying was carried out. The thickness of the obtained photosensitive film measured by a film thickness gauge (F20 manufactured by Fillmetrics, Inc. and marketed by Matsushita Techno Trading Co., Ltd.) was 7 μm. Then, laser exposure was carried out and the image was developed. With regard to the above-mentioned laser exposure, Laser Stream FX was used and predetermined pattern exposure was carried out with the exposure condition of 300 mJ/cm$^2$. Further, with regard to the above-mentioned development, a TLD developer (a developer manufactured by THINK LABORATORY Co., Ltd.) was used with the developer dilution ratio of (undiluted solution:water=1:7) and the development was carried out at 24° C. for 90 seconds to form a predetermined resist pattern.

A DLC coating film was formed by CVD on the surfaces of the nickel plating layer and the resist pattern. An intermediate layer was formed to have a thickness of 0.1 μm in an atmosphere of argon/hydrogen gas using hexamethyldisiloxane as a material gas at a film formation temperature of 80 to 120° C. for a film formation time period of 60 minutes. Then, a DLC layer was formed to have a thickness of 2 μm using toluene as a material gas at a film formation temperature of 80 to 120° C. for a film formation time period of 90 minutes.

The surface of the cylinder member obtained in this way was reciprocatively ground by a sandpaper grinding machine using a sandpaper having a grit size of #2000 (manufactured by 3M Company) at an angle of 30° for 2 minutes to form the grinding traces having a first angle which is 30° clockwise with respect to the imaginary extension of the doctor blade as illustrated in FIG. 3. Similarly, grinding traces having a second angle which is 30° counterclockwise with respect to the imaginary extension of the doctor blade were formed so that the grinding traces at the first angle and the grinding traces at the second angle intersect each other. When the grinding traces were observed under a light interference microscope, each of the grinding traces had the depth of 0.2 μm and the arithmetic mean roughness Sa of the surface in the non-printing area of 0.03.

The member with recessed portions obtained in this way was used to carry out electrode wiring pattern printing with ink containing silver paste by gravure printing. A beautiful electrode wiring pattern was obtained without causing fogging.

REFERENCE SIGNS LIST

10A, 10B: member with recessed portion, 12: surface, 14: recessed portion, 16: printing area, 18: non-printing area, 20: viscous material, 22: doctor blade, 24A, 24B: base member, 26: DLC coating, 28: imaginary extension, 30, 32: grinding trace, 34: cylindrical or flat plate-like base material, 36, 40: metal layer, 38: nickel plating layer, 42: copper plating layer, 44: nickel plating layer, 46: patterning layer, 48: impression cylinder, 50: target of printing.

The invention claimed is:

1. A member with recessed portions, comprising:

a printing area in which a large number of recessed portions are formed on a surface thereof; and a non-printing area in which the recessed portions are not formed on the surface thereof, the surface being brought into contact with a viscous material so that the viscous material accumulates in the recessed portions, the excess viscous material being scraped off the surface by causing a doctor blade extending horizontally across the surface to contact the surface and relatively moving the doctor blade, wherein:

the member with recessed portions further comprises:

a base member having the printing area in which the large number of recessed portions are formed on the surface and the non-printing area in which the recessed portions are not formed on the surface; and a DLC coating formed so as to cover the printing area and the non-printing area; and the surface is provided with a plurality of grinding traces, which are formed by grinding the DLC coating, and form an inclined angle of other than 0° and 90° with respect to an imaginary reference line corresponding to the doctor blade extending horizontally across and in contact with the surface, wherein a mean roughness Sa of the surface in the non-printing area of the member with recessed portions is 0.005 to 0.10 μm and the mean roughness surface Sa is a three-dimensional roughness defined by a volume surrounded by a curved surface shape and a mean plane divided by a measured area.

2. A member with recessed portions according to claim 1, wherein the plurality of grinding traces have a first angle corresponding to the inclined angle of other than 0° and 90° with respect to the imaginary extension of the doctor blade and a second angle corresponding to the inclined angle of other than 0° and 90° with respect to the imaginary extension of the doctor blade, and grinding traces at the first angle and grinding traces at the second angle intersect each other.

3. A member with recessed portions according to claim 1, wherein a depth of the plurality of grinding traces is 0.05 μm to 0.3 μm.

4. A member with recessed portions according to claim 1, wherein a depth of the recessed portions is 1 μm to 50 μm.

5. A member with recessed portions according to claim 1, wherein the base member comprises a base member body, and a metal layer provided on a surface of the cylindrical or flat plate-like base material and having the large number of recessed portions formed on the surface thereof.

6. A member with recessed portions according to claim 1, wherein the base member comprises a base member body, a metal layer provided on a surface of the cylindrical or flat plate-like base material, and a patterning layer formed by exposing and developing a photosensitive material provided on the metal layer.

7. A member with recessed portions according to claim 5, wherein the metal layer is made of copper or nickel.

8. A member with recessed portions according to claim 5, wherein the base material comprises a cushion layer formed of a rubber or a resin having a cushioning property.

9. A member with recessed portions according to claim 1, wherein a thickness of the DLC coating is 0.1 μm to 20.0 μm.

10. A member with recessed portions according to claim 1, wherein the member with recessed portions comprises a gravure printing cylinder.

11. A member with recessed portions according to claim 1, wherein the member with recessed portions comprises a deep-etch offset plate.

12. A member with recessed portions according to claim 1, wherein the member with recessed portions comprises an application cylinder.

13. A product, manufactured by using the member with recessed portions according to claim 1.

14. A method of manufacturing a member with recessed portions, the member with recessed portions including:

a printing area in which a large number of recessed portions are formed on a surface thereof; and a non-printing area in which the recessed portions are not formed on the surface thereof, the surface being brought into contact with a viscous material so that the viscous material accumulates in the recessed portions, the excess viscous material being scraped off the surface by causing a doctor blade extending horizontally across the surface to contact the surface and relatively moving the doctor blade, wherein:

the method comprising the steps of:

manufacturing a base member having the printing area in which the large number of recessed portions are formed on the surface and the non-printing area in which the recessed portions are not formed on the surface;

forming a DLC coating so as to cover the printing area and the non-printing area; and forming a plurality of grinding traces by grinding the DLC coating, the plurality of grinding traces forming an inclined angle of other than 0° and 90° with respect to an imaginary reference line corresponding to the doctor blade extending horizontally across and in contact with the surface, wherein a mean roughness Sa of the surface in the non-printing area of the member with recessed portions is 0.005 to 0.10 μm and the mean roughness surface Sa is a three-dimensional roughness defined by a volume surrounded by a curved surface shape and a mean plane divided by a measured area.

15. A method of manufacturing a member with recessed portions according to claim 14, wherein the step of forming a plurality of grinding traces comprises forming the plurality of grinding traces having a first angle corresponding to the inclined angle of other than 0° and 90° with respect to the imaginary extension of the doctor blade and a second angle corresponding to the an inclined angle of other than 0° and 90° with respect to the imaginary extension of the doctor blade so that the grinding traces at the first angle and grinding traces at the second angle intersect each other.

16. A method of manufacturing a member with recessed portions according to claim 14, wherein a depth of the plurality of grinding traces is 0.05 μm to 0.3 μm.

17. A method of manufacturing a member with recessed portions according to claim 14, wherein a depth of the recessed portions is 1 μm to 50 μm.

18. A method of manufacturing a member with recessed portions according to claim 14, wherein the step of manufacturing a base member comprises the steps of:

preparing a base member body;

providing a metal layer on a surface of the base member body; and forming by corrosion the large number of recessed portions on a surface of the metal layer.

19. A method of manufacturing a member with recessed portions according to claim 14, wherein the step of manufacturing a base member comprises the steps of:

preparing a base member body;

providing a metal layer on a surface of the base member body; and forming a patterning layer by exposing and developing a photosensitive material provided on the metal layer.

20. A method of manufacturing a member with recessed portions according to claim 18, wherein the metal layer is made of copper or nickel.

21. A method of manufacturing a member with recessed portions according to claim 18, wherein the base material comprises a cushion layer formed of a rubber or a resin having a cushioning property.

22. A method of manufacturing a member with recessed portions according to claim 14, wherein a thickness of the DLC coating is 0.1 μm to 20.0 μm.

23. A member with recessed portions according to claim 5, wherein the base member body is selected from a group of base member body shapes consisting of a cylinder and a flat plate.

24. A member with recessed portions according to claim 6, wherein the base member body is selected from a group of base member body shapes consisting of a cylinder and a flat plate.

25. A method of manufacturing a member with recessed portions according to claim 18, wherein the base member body is selected from a group of base member body shapes consisting of a cylinder and a flat plate.

26. A method of manufacturing a member with recessed portions according to claim 19, wherein the base member body is selected from a group of base member body shapes consisting of a cylinder and a flat plate.

27. A member with recessed portions according to claim 1, wherein when the mean plane is an xy plane, a vertical direction is a z-axis and the curved surface shape is z=f(x,y) and the mean roughness Sa is expressed by the following equation:

$$Sa = \frac{1}{L_x L_y} \int_0^{Lx} \int_0^{Ly} f(x, y)\, dx dy$$

where Lx is a measured length in an x direction and Ly is a measured length in a y direction.

28. A method of manufacturing a member with recessed portions according to claim 14, wherein when the mean plane is an xy plane, a vertical direction is a z-axis and the curved surface shape is z=f(x,y) and the mean roughness Sa is expressed by the following equation:

$$Sa = \frac{1}{L_x L_y} \int_0^{Lx} \int_0^{Ly} f(x, y)\, dx dy$$

where Lx is a measured length in an x direction and Ly is a measured length in a y direction.

* * * * *